US008919014B2

(12) United States Patent
Perry

(10) Patent No.: US 8,919,014 B2
(45) Date of Patent: Dec. 30, 2014

(54) WOMAN'S HIGH HEEL PROTECTOR

(71) Applicant: Just for KiiX, LLC, Raleigh, NC (US)

(72) Inventor: Samuel Graham Perry, Cary, NC (US)

(73) Assignee: Just for KiiX LLC, Raleigh, NC (US)

( * ) Notice: Subject to any disclaimer, the term of this patent is extended or adjusted under 35 U.S.C. 154(b) by 0 days.

(21) Appl. No.: 14/031,873

(22) Filed: Sep. 19, 2013

(65) Prior Publication Data

US 2014/0075790 A1 Mar. 20, 2014

Related U.S. Application Data

(63) Continuation-in-part of application No. 13/622,398, filed on Sep. 19, 2012.

(51) Int. Cl.

| | |
|---|---|
| ***A43B 3/16*** | (2006.01) |
| ***A43B 23/00*** | (2006.01) |
| ***A43B 21/22*** | (2006.01) |

(52) U.S. Cl.

CPC ..... *A43B 23/00* (2013.01); *A43B 3/166* (2013.01); *A43B 21/22* (2013.01)

USPC ..... 36/72 R; 36/72 B

(58) Field of Classification Search

USPC ..... 36/72 R, 72 B

See application file for complete search history.

(56) References Cited

U.S. PATENT DOCUMENTS

| | | | | |
|---|---|---|---|---|
| 3,153,289 | A * | 10/1964 | Martin | 36/72 B |
| 4,756,097 | A * | 7/1988 | Sanders | 36/72 B |
| D300,780 | S | 4/1989 | Walls | |
| 5,052,129 | A * | 10/1991 | Lobasso et al. | 36/72 R |
| 5,357,694 | A * | 10/1994 | Mauck | 36/72 B |
| 7,730,638 | B2 | 6/2010 | Urbach et al. | |
| D630,826 | S | 1/2011 | Boyer | |
| 2008/0216363 | A1* | 9/2008 | Alexander | 36/72 B |
| 2009/0119946 | A1* | 5/2009 | Baker | 36/7.2 |
| 2011/0232137 | A1* | 9/2011 | Desiderio et al. | 36/72 B |
| 2014/0075789 | A1* | 3/2014 | Perry | 36/72 B |
| 2014/0075790 | A1* | 3/2014 | Perry | 36/72 B |

FOREIGN PATENT DOCUMENTS

| | | | |
|---|---|---|---|
| DE | 19500110 | A1 | 11/1996 |
| DE | 102009051289 | A1 | 5/2011 |

* cited by examiner

*Primary Examiner* — Marie Bays

(74) *Attorney, Agent, or Firm* — Williams Mullen, PC; Joshua B. Brady

(57) ABSTRACT

A device for the protection of a high heel is disclosed which is adjustable to adapt to various shoe heel diameters and is barely visible during use.

17 Claims, 4 Drawing Sheets

WOMAN'S HIGH HEEL PROTECTOR

This application is a continuation-in-part of U.S. non-provisional application Ser. No. 13/622,398 filed on Sep. 19, 2012 which is included herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to devices for protecting shoes. In particular, the present invention relates to a method for protecting the raised heel of a woman's high heel shoe.

2. Description of Related Art

Women's high heel shoes are typically designed for dress-up occasions. They are designed to add height to a woman's stature as well as accent the musculature of the leg. While high heels have become thicker and flatter, the typical stiletto type high heel is still very popular as are other types of high heels. One problem that occurs when wearing stiletto heels or other such heels is the ease with which the heel portion of the shoe can become damaged. While the very bottom of the heel is replaceable, the upper portion that is normally colored is affixed to the shoe and is for the most part not replaceable without great cost if at all.

Damage to the upper portion of a high heel is very noticeable and can cause the shoe to be unwearable from a fashion standpoint. Very little has been available to address this problem which has been around as long as there have been high heels. One attempt is shown in German patent DE 10 2009 051 289 A1 to Vera Zwiauer. In this attempt, a rectangular piece of material is wrapped around the lower portion of the upper heel. However, since a heel is not perfectly cylindrical and is tapered, the material bunches up in spots and must be overlapped causing a visible bulge when mounted. To date, this device has not seen any commercial use most likely because of fit problems as well as poor decorative look.

BRIEF SUMMARY OF THE INVENTION

The present invention involves the discovery that a tapered clear plastic material that is adjustable in size, e.g. by tearable perforations, allows the user to adjust a covering for the lower portion of the upper high heel in a manner that is barely visible during use and avoids fit problems.

Accordingly, in one embodiment of the invention, there is disclosed a device for protecting the lower portion of a woman's tapered stiletto or high heel of a given diameter and taper above the replaceable heel portion comprising a piece of clear film having a lower portion of an essentially trapezoidal shape of a fixed height and width wherein the device is adjustable in width and taper to fit the diameter and taper of the heel and an upper tapered portion wherein the height of the tapered portion is adjustable and wherein there is an adhesive film on one side of the device for adhering the device to the tapered heel.

DETAILED DESCRIPTION OF THE INVENTION

Figure 1:
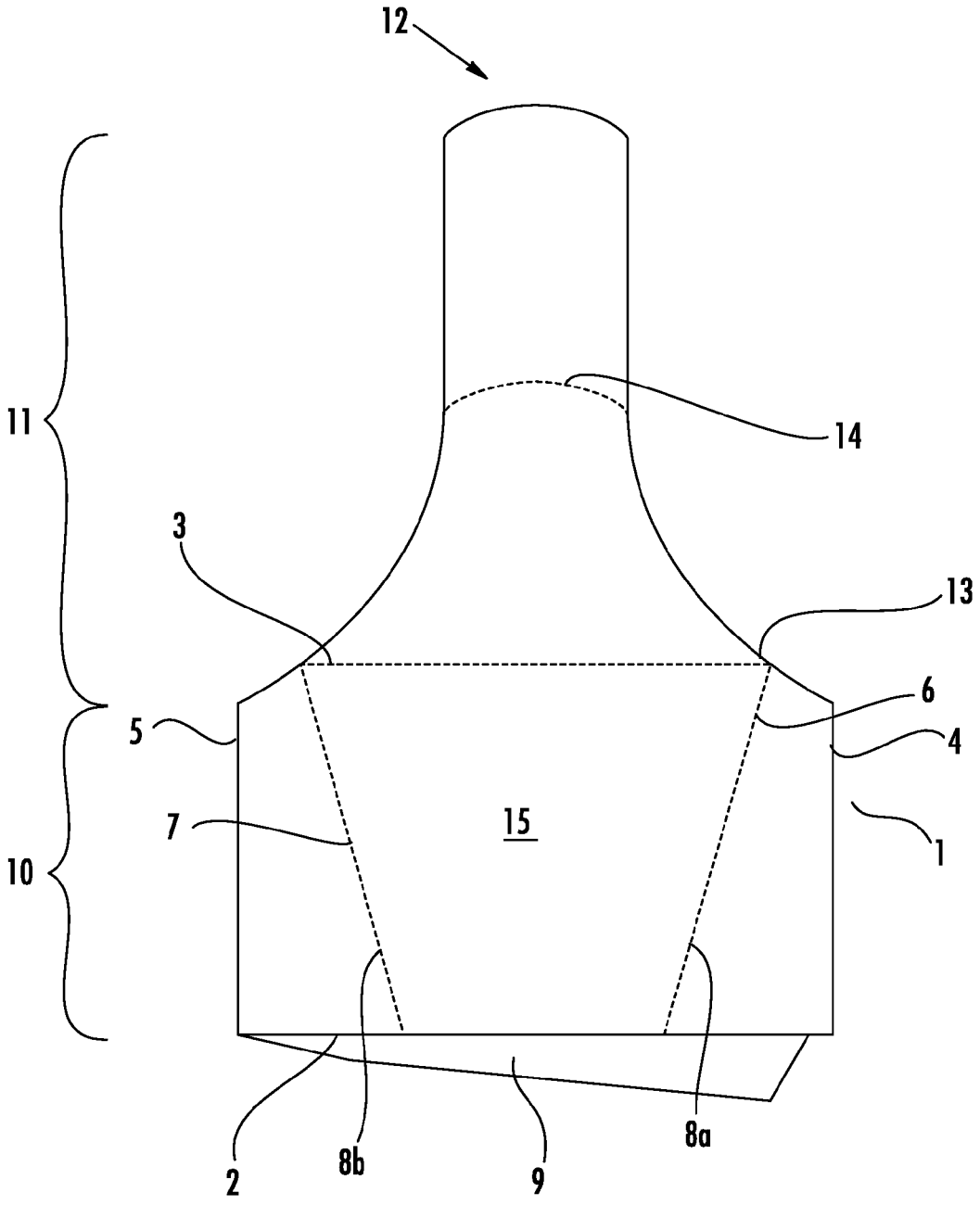
FIG. 1 is a frontal view of the device of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "about" and "essentially" mean±10 percent.

The term "comprising" is not intended to limit inventions to only claiming the present invention with such comprising language. Any invention using the term comprising could be separated into one or more claims using "consisting" or "consisting of" claim language and is so intended.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein the term "woman's stiletto" or "high heel" is the standard tapered woman's shoe heel as depicted in the figures and well known in the art. It is the generally non-replaceable part of the shoe heel. While a variety of different diameters and tapering exist (which has created the problem solved herein) the general style of heel is shown and well known. As used herein, the "lower portion of the stiletto or high heel" is the very bottom portion of the heel just above the replaceable heel (heel cap or heel tip) which is usually some sort of leather, rubber, or plastic portion that is worn down during walking and can be easily replaced by a cobbler. The upper portion of the heel is where the heel is attached to the rest of the shoe. The heel is essentially permanently attached to the shoe and is generally not replaceable. For purposes of this invention, the non-replaceable heel will have a lower portion that extends from the replaceable heel portion upwards to a desired height, such as ¾, half or a quarter, up the entire heel as necessary. The heel will have a diameter that varies depending on the distance from the replaceable heel but generally tapered as well. The problem being solved by the present invention is in part dealing with this variable diameter and taper of the heel and still making the device unobtrusive and effective.

As used herein the term "clear plastic film" refers to a polymer film that is see tough and flexible enough to wrap around the stiletto heel in use. Examples of polymers suitable for the present invention include polyurethane but based on this disclosure, others are taught. The polymer has an adhesive backing. The adhesive is one that is compatible with the polymeric film and sticks to the material the outer surface of the heel is made of so for example it may need to be compatible with leather, plastic coatings or the like. As an example silicone adhesive could be used. Other adhesives could be used or found with little experimentation based on the disclosure herein.

The polymeric film will have a lower portion of an essentially trapezoid shape (including a rectangle shape) having a fixed height and width or tapered width in a manner to match the stiletto or high heel shape (tapered heel). Generally the width of the present invention will be greater than the height but may change depending on the exact heel to be adapted. In order to be useful on a wide variety of heels, the straight or tapering sides have one or more adjustable features, for example, perforations which allow the width and taper to be adjusted to fit the circumference of the heel and taper of the heel and make a fit with little or no bulge. Perforations can be done in any convenient manner such as between about 2 perforations to about 12 perforations per inch. For example, perforations could be 0.07" cut to 0.08" cut and 0.01" tear to 0.02" tear. It will have an upper portion that is tapered and is adjustable in height. Again, adjustability can be by perforations which adjust the height of the upper portion.

The circumference of the heel is the distance around the heel as shown in the figures, however, a wide variety of heels could be produced for a variety of heels but all can be made adjustable within the scope of the present invention. In one embodiment, there is a non-adhesive backing to protect the adhesive backing until the film is applied to the heel of choice.

In applying the device of the present invention to a heel, the device's middle line is aligned with the center back of the heel and is positioned around the stiletto heel and portions of the side and top portion removed excess device until wrapping it around the heel matches the circumference and/or taper of the heel. Then the removable backing is removed and the device's side is placed against the heel (as shown in the figures), wrapped around the heel, and smoothed to remove any air bubbles and make sure it matches. In one embodiment, the seam created by the device is placed where it is least likely to be seen, that is facing the toe of the stiletto or high heel shoe.

Now referring to the figures, FIG. 1 is a frontal profile of the device of the present invention. Protective wrap 1 is shown having trapezoid bottom portion 10 having parallel top 3 and bottom 2 and parallel sides 4 and 5. (This example depicts a rectangle but nonparallel sides are also contemplated.) The device has left side 7 and right side 6 which are tapering from the top side 3 to the bottom side 2 to form a trapezoidal shape when torn on 8*a*. In order to adjust the width of the device 1, diagonal perforations 8*a* and 8*b* are shown in the rectangular portion.

In FIG. 1 the device 1 has diagonal perforation 8*a* being which can be torn to remove that piece and narrow the width as well as perforating for adjusting the height of lower portion 10. It is clear there can be one or more perforations as desired to narrow the width of the device and the perforations can be angled as needed. One skilled in the art in view of this disclosure, could easily determine placement of perforations. Also shown is backing 9 which in this drawing is in the process of being pulled off the back side of device 1 which is being shown from the front side 15. An adhesive would be on the back side.

FIG. 1 shows tapered upper portion 11. The upper portion 11 is tapered from the lower portion 10 down to the rounded top 12. Perforations 13 and 14 are also shown for adjusting height.

Figure 2A:
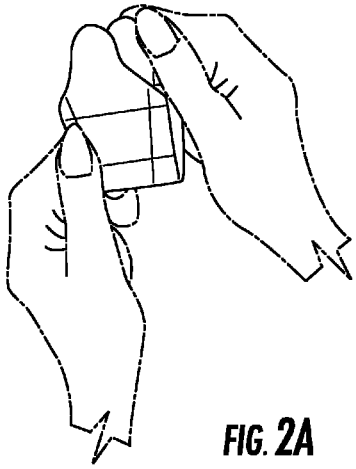
FIGS. 2*a*, 2*b* and 2*c* are a perspective view of the device wrapping around a stiletto heel.
Figure 2B:
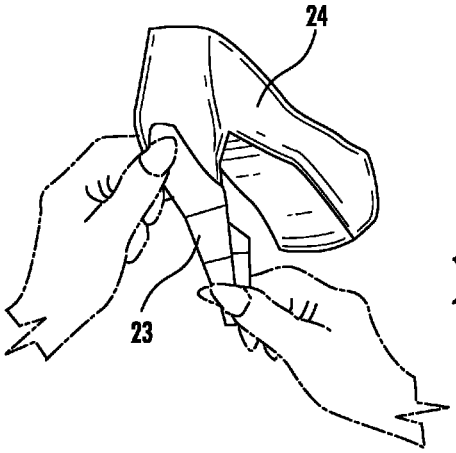
Figure 2C:
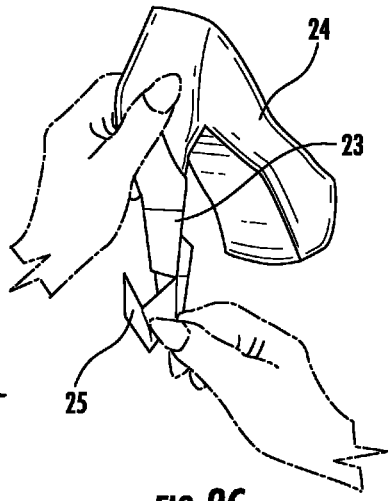

FIGS. 2*a*, 2*b*, and 2*c* are a perspective series of the device 1 being wrapped around the lower portion of stiletto heel 23 on shoe 24. Also shown is the replaceable heel cap 25. While the wrapping is such that the seam will be to a side of the shoe 24, in one embodiment, the seam is positioned to face shoe toe 26 (as shown in FIG. 3).

Figure 3:
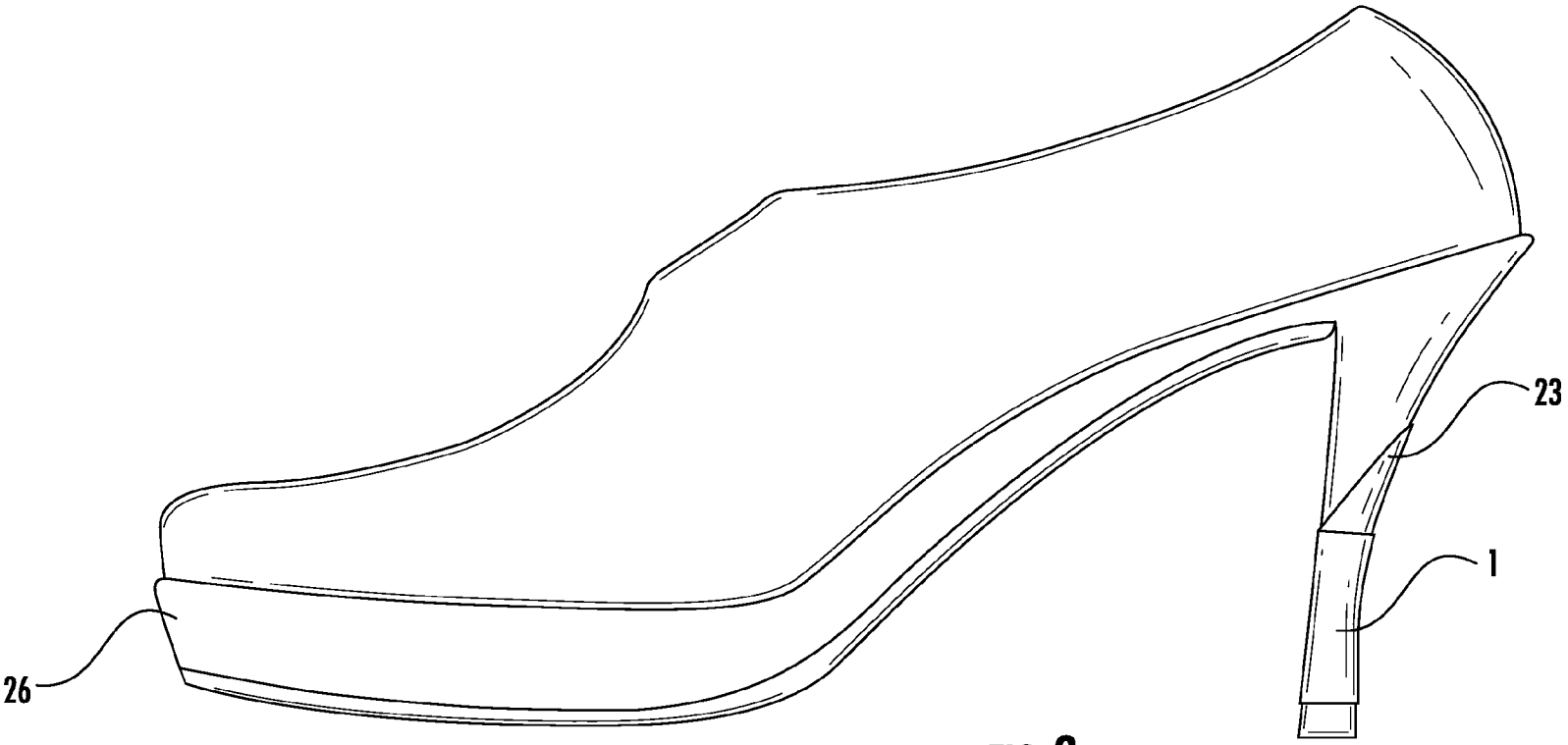
FIG. 3 is a perspective view of the device mounted on a stiletto heel.

FIG. 3 shows a perspective of the device completely wrapped around heel 23 without seems or bulges. Notice that it is mounted on the lower portion of the heel 23 but any height of the heel can be chosen especially with the adjustable height feature. When in place, it protects the heel from scuffing or damage and can be removed and replaced with a new device easily and quickly.

Figure 4:
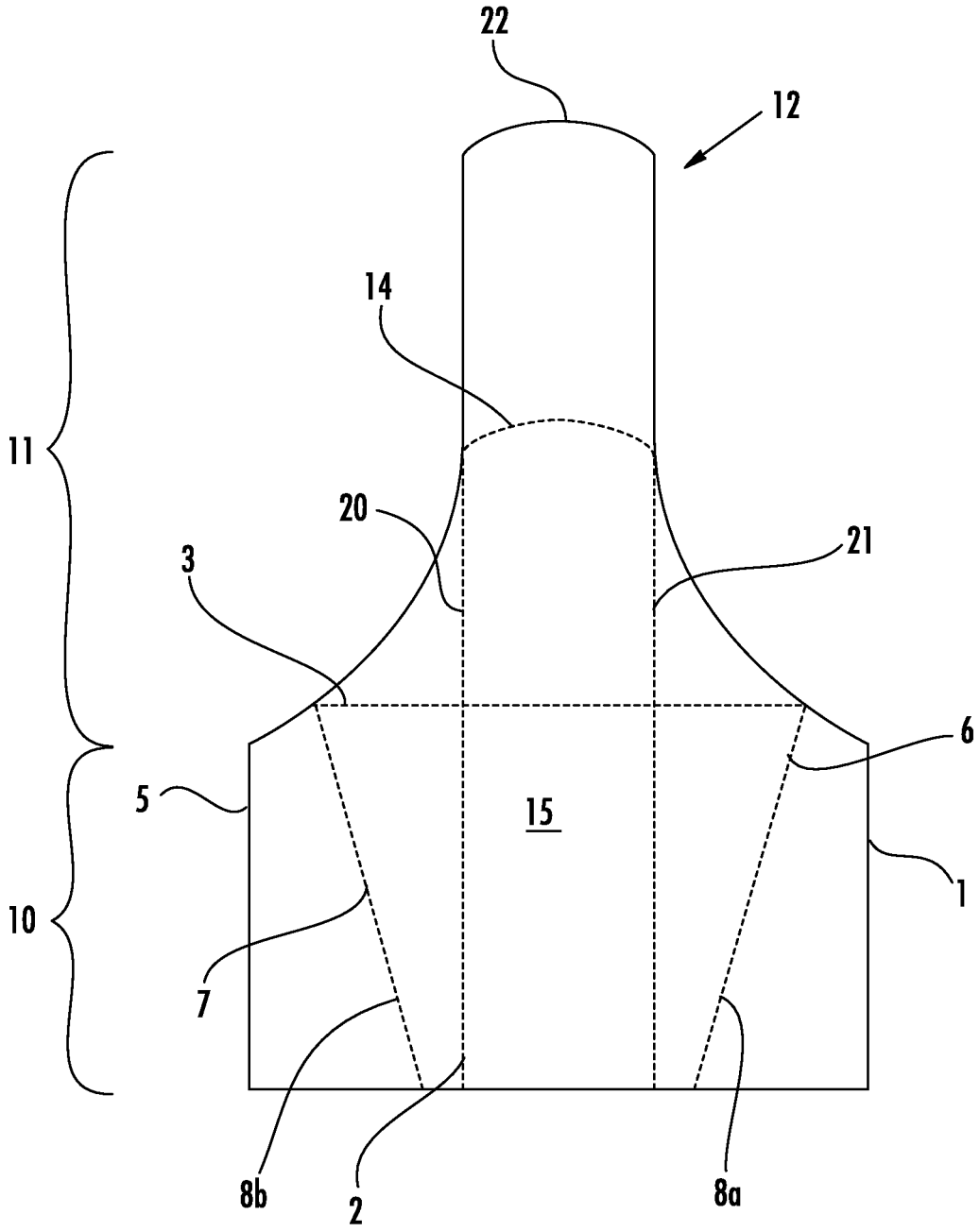
FIG. 4 is a frontal view of an alternate embodiment of the present invention.

FIG. 4 depicts another embodiment of the present invention. In this view the device 1 has additional vertical width adjusts perforations 20 and 21 which extend from the tapered portion 11 to the trapezoidal portion 10. Also shown is notch 22 for making it easier to peel backing (not shown in this view) off of device 1.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A device for protecting the lower portion of a woman's tapered stiletto or high heel of a given variable diameter and taper above the heel cap portion, the device comprising:

a piece of clear film having an adjustable lower portion and an adjustable upper portion;

the adjustable lower portion having a bottom edge and a pair of lower side edges having a first end and a second end, each first end extending upward from the bottom edge;

a first pair of perforations extending upward from the bottom edge for adjusting the width of the lower portion;

the adjustable upper portion having a top region with a pair of upper side edges and a top edge, and a tapered region extending upward from the second ends of the lower side edges toward the upper side edges of the top region and tapered such that the width of the tapered region decreases from the lower side edges toward the upper side edges;

an upper perforation between the upper side edges for adjusting the height of the upper portion; and an adhesive backside for adhering the device to the high heel.

2. The device according to claim 1 wherein the lower side edges extend perpendicularly from the bottom edge.

3. The device according to claim 1 wherein the film is made of polyurethane.

4. The device according to claim 1 wherein the adhesive backside comprises a silicone adhesive.

5. The device according to claim 1 wherein there is a removable backing over the adhesive backside.

6. The device according to claim 1 wherein the tapered region is rounded concave outward.

7. The device according to claim 1 wherein the top edge is rounded concave inward.

8. The device according to claim 1, wherein the upper side edges are parallel.

9. The device according to claim 1, further comprising a second upper perforation extending between a first side and a second side of the tapered region.

10. The device according to claim 1, further comprising a second pair of perforations extending upward from the bottom edge for adjusting the width of the lower portion.

11. The device according to claim 10, wherein the second pair of perforations extend to the upper portion.

12. The device according to claim 11, wherein the second pair of perforations extend to the upper side edges.

13. The device according to claim 1, wherein each perforation in the first pair of perforations extends to the tapered region.

14. The device according to claim 1, wherein the distance between the first pair of perforations increases upward from the bottom edge.

15. The device according to claim 1, further comprising a plurality of perforation pairs extending upward from the bottom edge for adjusting the width of the lower portion.

16. The device according to claim 1, further comprising a plurality of upper perforations in the upper portion for adjusting the height of the upper portion.

17. The device according to claim 1, wherein the upper perforation is concave opening toward the bottom edge.

* * * * *